United States Patent [19]

Shore

[11] Patent Number: 4,728,106

[45] Date of Patent: Mar. 1, 1988

[54] GOLF PUTTING PRACTICE DEVICE

[76] Inventor: Robert E. Shore, 6731 Leland Way, Apt. 423, Los Angeles, Calif. 90028

[21] Appl. No.: 764,597

[22] Filed: Aug. 12, 1985

[51] Int. Cl.[4] ..... A63B 69/36

[52] U.S. Cl. ..... 273/177 R

[58] Field of Search ..... 273/178 R, 177 R, 179 C, 273/177 A, 177 B, 178 A, 178 B, 179 R, 179 A, 179 B, 179 D, 179 E, 180

[56] References Cited

U.S. PATENT DOCUMENTS

| | | | |
|---|---|---|---|
| 884,277 | 4/1908 | Hughes | 273/178 R |
| 2,938,729 | 5/1960 | Billfadt | 273/178 R |
| 3,424,463 | 1/1969 | Matthews | 273/179 C |
| 3,494,620 | 2/1970 | Schmudde et al. | 273/177 R |
| 4,429,882 | 2/1984 | Stanton | 273/177 R |

*Primary Examiner*—George J. Marlo

[57] ABSTRACT

A golf putting practice device, one embodiment of which comprises a thin, flat ball support in the front portion thereof which supports a ball rolling rearwardly to a simulated golf hole area having a very shallow front rim, which allows a ball to fall slightly when rolling rearwardly thereacross, and which permits a ball rolling with sufficient speed to also roll outwardly thereacross. An area rearward of the front rim slopes upwardly from front to rear while also sloping upwardly from each of the respective outer sides thereof toward the longitudinal center of the device, so that a ball may be permitted to roll by gravity in a forward and outward direction toward either of the respective sides of the device, so that the ball may roll off the device to a position outside of the path of a subsequently putted ball. A concave rear wall is located rearward of the sloping area and simulates the rear wall and rim of a golf hole. The height of the wall is such that when a golf ball is putted rearwardly toward the device at a speed greater that the approximate maximum speed at which the ball could be putted toward a golf hole at a corresponding location, and fall into the hole, the ball will pass over the wall; while a ball putted at a speed which is not greater than the corresponding approximate maximum speed will not pass over the wall. A ball which strikes the rear wall within the approximate width of a golf hole will deflect inwardly to indicate the proper direction of the ball.

3 Claims, 4 Drawing Figures

GOLF PUTTING PRACTICE DEVICE

This invention relates to the sport of golf and in particular to an improved putting practice device which simulates a golf hole.

Heretofore several putting practice devices have provided means for permitting a golf ball which has been putted thereon at a suitable speed and location to roll by gravity off the device to a position outside of the path of a subsequently putted ball. However, these devices required that a putted ball roll upwardly a considerable distance on an inclined surface in the front portion of the device before reaching a simulated golf hole area on the device, the ball thereby losing a substantial amount of speed.

It is therefore one object of this invention to provide an improved putting practice device which will permit a putted golf ball to roll onto the device and to a simulated golf hole area with a reduced amount of impedance to the travel of the ball, while also permitting a ball which has been putted at a suitable speed and location to roll by gravity off the device to a position outside of the path of subsequently putted ball.

It is another object of this invention to provide a putting practice device which will provide an indication to the player as to when the speed of a putted ball is greater than the approximate maximum speed at which a golf ball could be putted toward a regular golf hole at a corresponding location and fall into the hole, and to also provide an indication as to when the direction of a putted ball is such that the ball is within a width simulating the width of a golf hole.

It is another object of this invention to provide a putting practice device which is compact and durable, which may be manufactured economically and which closely simulates a regular golf hole in appearance and in the action of a golf ball which is putted thereon.

Other object of this invention will become apparent as the description proceeds in connection with the accompanying drawings, of which:

Briefly summarized, one embodiment of the invention comprises a thin, flat ball support in the front portion thereof which supports a ball rolling rearwardly to a simulated golf hole area having a very shallow front rim, which allows a ball to fall slightly when rolling rearwardly thereacross, and which permits a ball rolling with sufficient speed to also roll outwardly thereacross. An area rearward of the front rim slopes upwardly from front to rear while also sloping upwardly from each of the respective outer sides thereof toward the longitudinal center of the device, so that a ball may be permitted to roll by gravity in a forward and outward direction toward either of the respective sides of the device, so that the ball may roll off the device to a position outside of the path of a subsequently putted ball. A concave rear wall is located rearward of the sloping area and simulates the rear wall and rim of a golf hole. The height of the wall is such that when a golf ball is putted rearwardly toward the device at a speed greater than the approximate maximum speed at which the ball could be putted toward a regular golf hole at a corresponding location, and fall into the hole, the ball will pass over the wall; while a ball putted at a speed which is not greater than the corresponding approximate maximum speed will not pass over the wall. A ball which strikes the rear wall within the approximate width of a golf hole will deflect inwardly.

Figure 1:
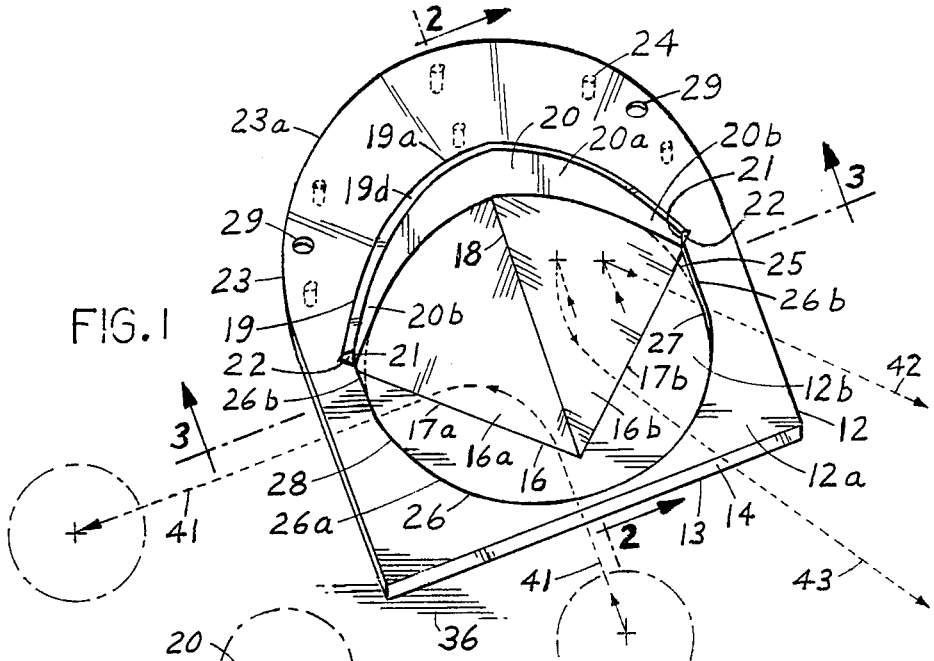
FIG. 1 is a perspective view of one embodiment of the invention.
Figure 2:
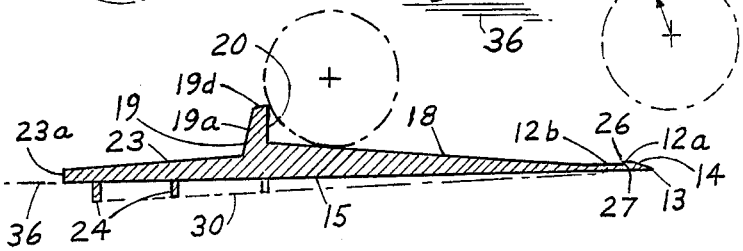
FIG. 2 is a cross-sectional view taken along the line 2—2 of FIG. 1.
Figure 3:
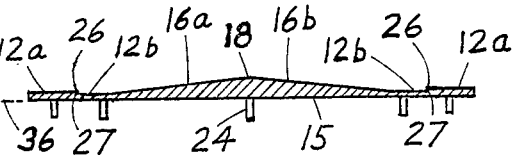
FIG. 3 is a cross-sectional view taken along the line 3—3 of FIG. 1.

Referring now to the figures, one embodiment of the invention is illustrated in FIG. 1. The device is preferably molded in one piece using material such as plastic or rubber. The material may be either rigid or somewhat resilient. The bottom surface 15 of the device is substantially flat. A ball support 12 is located in the front portion of the device and is of a thickness which is substantially a minimum consistent with strength. The width of the ball support 12 is somewhat greater than the width of a regular golf hole, with the respective outer sides thereof being disposed approximately parallel to, and equidistant from, the longitudinal center of the device. The front edge 13 of the ball support is substantially normal to the longitudinal center of the device. The front face 14 of the ball support is beveled upwardly from front to rear, the front face being the surface at the front of the ball support which extends upwardly from the bottom surface of the ball support to join the upper surface thereof, and which is contained within the thickness of the material which forms the ball support.

The ball support 12 is made up of two portions, an outer portion **12*a* located outside of a front rim 26, and an inner portion 12*b* located inside the front rim 26. The bottom surfaces of both portions are substantially flat and are aligned with, and form part of, the overall flat bottom surface 15 of the device. The upper surfaces of both portions 12*a* and 12*b* are substantially parallel to the bottom surfaces thereof. The thickness of the outer portion 12*a* is somewhat greater than the thickness of the inner portion 12*b* so that a shallow, vertical front wall 27 is formed below the front rim 26, and extends upwardly from the upper surface of the inner portion 12*b* to join the upper surface of the outer portion 12*a* of the ball support 12. The front rim 26 is thus formed at the intersection of the front wall 27 with the upper surface of the outer portion 12*a* of the ball support 12. The height of the front wall 27 is sufficiently large so that when the center of a golf ball rolling rearwardly upon the portion 12*a* of the ball support at a slow speed passes across the front rim 26 the ball will fall sufficiently to permit the ball to be retained inside the front rim; while the height of the front wall 27 is sufficiently small so that a ball rolling outwardly with sufficient speed upon the inner portion 12*b* of the ball support may roll across the front rim 26 and onto the outer portion 12*a* of the ball support. The height of the front wall 27** may be approximately 0.03 inches, although greater or lesser heights may be used.

The front rim 26 is located rearward of the front face 14 of the ball support 12 and is made up of an approximately semi-circular portion **26*a* and two straight side portions 26*b*. The semi-circular portion 26*a* has a radius approximately equal to the radius of a regular golf hole, with the center of the radius being on the longitudinal center of the device. The respective straight side portions 26*b* are tangent to the respective outer sides of the semi-circular portion 26*a*** and extend rearwardly along lines parallel to the longitudinal center of the device.

Figure 4:
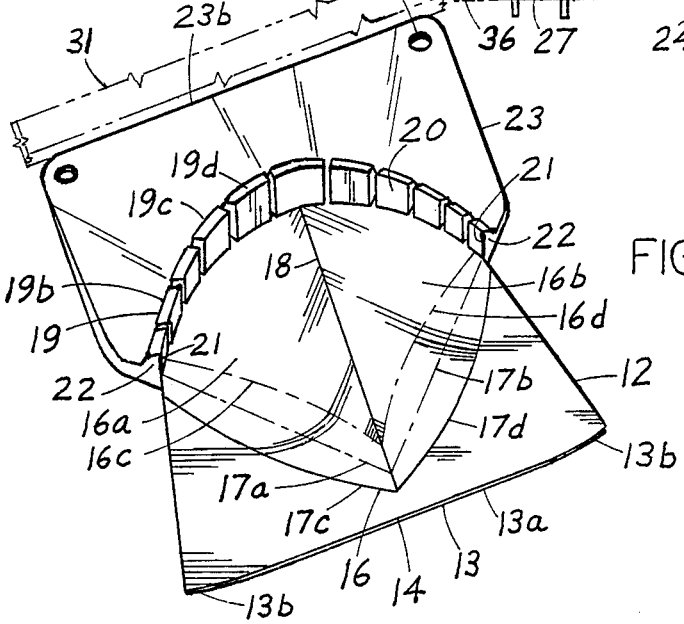
FIG. 4 is a perspective view of another embodiment of the invention.

A sloping area 16 is located rearward of and inside the front rim 26 and is made up of two sloping plane surfaces, 16*a* on the left, and 16*b* on the right. The respective outer edges of the plane surfaces join the upper surface of the inner portion 12*b* of the ball support 12 along the lines 17*a* and 17*b*, which extend from the rear ends of the respective straight side portions of the front wall 27 and join at the longitudinal center of the device. The lines 17*a* and 17*b* are disposed at angles of approximately 45 degrees from the longitudinal center of the device. Each of the respective plane surfaces slopes upwardly from front to rear while also sloping upwardly from the outer side thereof toward the longitudinal center of the device, where the plane surfaces join to form a ridge 18 which slopes upwardly from front to rear. Each of the respective plane surfaces 16*a* and 16*b* therefore slopes downwardly in a forward and outward direction, with the direction of the steepest slope being at an angle of approximately 45 degrees from the longitudinal center of the device. The degree of slope is at least sufficient to permit a ball to roll downwardly by gravity when the device is resting on a horizontal playing surface. It is desirable that the degree of slope be somewhat greater than the the minimum required. A degree of slope of approximately 6 degrees to 7 degrees may be used, although greater or lesser degrees may be used. The intersection of the sloping area 16 with the ball support 12 may be filleted, the fillet having a radius greater than the radius of a golf ball to permit a ball to roll smoothly onto the sloping area. A fillet is not shown in FIG. 1, however one type of fillet is shown in the embodiment of FIG. 4.

A barrier 19 is located rearward of the sloping area 16 and the ball support 12, and, in the embodiment of FIG. 1, comprises a solid, upstanding rear wall 19*a* attached at its base to the sloping area and the ball support. The front face 20 of the wall is vertical, and is made up of an arcuate central portion 20*a* and two outer straight side portions 20*b*. The arcuate portion has an arc radius approximately equal to the radius of a golf hole, with the center of the radius being located on the longitudinal center of the device at approximately the same position as the center of the radius of the front rim 26. The respective outer side portions 20*b* are tangent to the arcuate portion 20*a* and extend forwardly and outwardly at angles of approximately 45 degrees from the longitudinal center of the device. The total width of the front face 20 of the rear wall 19*a* is approximately the width of a golf hole, with the respective outer ends 21 of the front face 20 being disposed approximately equidistantly from the longitudinal center of the device, and joining the rear ends of the respective side portions 26*b* of the front rim 26. The respective exterior side faces 22 of the rear wall 19*a* are disposed at angles of approximately 90 degrees from the respective outer portions 20*b* of the front face of the wall. The top surface 19*d* of the rear wall 19*a* may slope downwardly toward the rear of the device to permit a ball which has bounced onto the top surface 19*d* to bounce or roll off the top surface in a rearward direction. The area enclosed within the perimeters of the front face 20 of the rear wall 19*a* and the front rim 26 forms a simulated golf hole area 28 representing the area of the opening of a regular golf hole.

The rear wall 19*a* provides a predetermined amount of resistance to the travel of a golf ball rolling rearwardly upon the sloping area 16 or the ball support 12, the amount of resistance being related to the height and rigidity of the wall. The height of the wall is such that a rearwardly rolling golf ball will pass over the wall if the speed of the ball, as it strikes the wall, is greater than an approximate maximum speed pertaining to the particular location struck; while the ball will not pass over the wall if it strikes the wall at a speed which is not greater than the approximate maximum speed for the particular location. In order that the device may best simulate a golf hole, the rear wall 19*a* provides an indication to the player as to whether or not the speed of a rearwardly putted golf ball rolling toward the device on a path parallel to the longitudinal center thereof is greater than the approximate maximum speed at which a ball may be putted toward a regular golf hole, at a corresponding location, and fall into the hole. To establish the height of the rear wall 19*a* so that it will provide this indication, the loss of speed of the ball as it travels from the playing surface onto and across the device, and the lateral deflection of the ball as it rolls across the sloping area 16, before reaching the rear wall 19*a*, must be accounted for. One method which may be used to account for this loss of speed, and this deflection, when establishing the height of the rear wall 19*a* is described as follows:

Measure the maximum speed at which a golf ball may be rolling toward a regular golf hole and fall into the hole, when the ball is rolling toward the center of the hole, and when rolling toward the hole at incremental distances from the center of the hole. Make these speed measurements at a line which is in front of the hole and which is normal to the paths of the balls, the distance from the speed measuring line to the center of the rear rim of the golf hole being equal to the distance from the front edge 13 of the device to the center of the rear wall 19*a*. It is noted that the maximum speed at which a golf ball may be traveling and fall into a golf hole will vary substantially from hole to hole; therefore representative average maximum speeds may be chosen for use in establishing the height of the rear wall 19*a*.

With the device resting on a suitable playing surface 36, roll golf balls rearwardly toward the device on paths parallel to the longitudinal center thereof, and at incremental distances from the longitudinal center corresponding to the incremental distances from the center of the golf hole used in making the maximum speed measurements. Roll several golf balls to the device at each location, and establish the height of the rear wall 19*a* so that, on the average, when a golf ball reached the front edge 13 of the device while travelling at the maximum speed at which the ball could travel toward a golf hole at a corresponding location, and fall into the hole, the ball will not pass over the wall; while, on the average, when the ball reached the front edge of the device at a speed greater than the maximum speed for the corresponding location, the ball will pass over the wall.

It is noted that there will be variations in the amount of speed lost by balls as they roll from the playing surface 36 onto the device because of variations in the bouncing of the balls as they approach the device. These variations of speed will cause variations in the amount of lateral deflection of balls as they roll rearwardly across the sloping area 16. There will also be variations in the bouncing of balls on the device as they approach the rear wall 19*a*, resulting in variations in the amount of resistance to the travel of the balls provided by the rear wall 19*a*. Because of these and other variations involved, the ball speed indication provided by the rear wall 19*a* will be an approximate indication and will pertain to an approximate maximum speed of a golf ball as it reached the front edge of the device.

A target area 25 is located between the front rim 26 and the rear wall 19*a*, and comprises an approximately circular area on the upper surface of the device which is colored a different color than the rest of the upper surface of the device, to serve as target representing the area of the opening of a regular golf hole. The target area has a radius approximately equal to the radius of a golf hole, with the center of the radius being located on the longitudinal center of the device.

An anti-tipping stabilizer 23 is located rearward of, and is attached to, the barrier 19 and the ball support 12, and extends rearwardly and outwardly from the barrier a sufficient distance to provide suitable support against rearward tipping of the device upon impact of a putted ball against the barrier. The anti-tipping stabilizer has a substantially flat bottom surface which is aligned with, and forms part of, the overall flat bottom surface 15 of the device, and has a thickness sufficient to prevent excessive bending, the thickness preferably being greatest at the juncture with the barrier 19 and decreasing toward the outer and rear edges of the anti-tipping stabilizer. The rear edge 23*a* is suitably curved.

A plurality of anti-sliding stabilizers 24 are attached to, and extend downwardly and normally from, the bottom surface 15 of the device, and are in the form of circular rods which have sufficient thickness for suitable strength while being sufficiently thin so that they may penetrate between the fibers of a carpet used as a playing surface. The rods are sufficiently short to permit the device to rest firmly on a suitable carpet or golf green. A suitable number of rods may be used to stabilize the device against excessive sliding upon impact of a putted ball against the device. The rods are preferably located in the rear portion of the device with the length of the most rearward rods being greatest, and the lengths of the rods in more forward locations becoming progressively shorter so that the bottom ends of the rods fall on a theoretical plane 30 which, if extended forwardly, would join the front edge 13 of the ball support 12; thus enabling the front edge 13 to rest firmly on a playing surface which does not permit the rods to penetrate below the upper edge of the playing surface.

A pair of holes 29 are located in the anti-tipping stabilizer 23, and are of a suitable size so that golf tees or suitable pins may be inserted through the holes into a golf green or suitable playing surface to stabilize the device against sliding.

The device illustrated in FIG. 1 may be used by placing it on a suitable playing surface 36 such as an indoor carpet or a regular golf green. For most accurate operation, the device should be oriented so that balls putted rearwardly thereto will reach the device while traveling on paths approximately parallel to the longitudinal center of the device; thus there will be a minimum of lateral deflection of a ball as it crosses the front edge 13. The upper surface of the outer portion 12*a* of the ball support 12 supports a rearwardly rolling ball on a surface which is substantially parallel to the playing surface, so that the ball may roll to the front rim 26 with a minimum of lateral deflection. Similarly, the upper suface of the inner portion 12*b* of the ball support 12 supports a ball as it rolls rearwardly from the front rim 26 to the sloping area 16, or to an outer portion of the barrier 19 which the ball may contact before reaching the sloping area. Thus, the upper surface of the ball support 12 supports, on a surface which is substantially parallel to the playing surface, a golf ball as it rolls rearwardly to reach any adjacent member of the device which is located within a width on the device simulating the width of a golf hole; an adjacent member of the device being any other member of the device which a golf ball may contact while rolling rearwardly on a portion of the upper surface of the ball support. The ball support 12 also permits a ball rolling with sufficient speed to roll from any adjacent member across the ball supports and onto the playing surface.

The front rim 26 provides an indication as to when the center of a rearwardly rolling ball has reached a position inside the front perimiter of the simulated golf hole area 28, the ball dropping slightly when passing over the front rim. Because of the shallow height of the front rim, a ball rolling with sufficient speed may then roll from the simulated golf hole area 28 across the front rim 26. A ball which has only sufficient speed to roll rearwardly across the front rim 26 will remain on the device inside the front rim.

A ball which rolls rearwardly across the front rim 26 with sufficient speed may roll directly onto the sloping area 16 or may deflect from an outer portion of the barrier 19 onto the sloping area. The sloping area 16 permits a ball which has rolled thereon at a suitable speed and location to roll by gravity in a direction leading sufficiently outwardly toward either of the respective outer sides of the device, so that the ball may roll from the sloping area onto and across the inner portion 12*b* of the ball support, across the front rim 26, and across the outer portion 12*a* of the ball support onto the playing surface 36, to a position outside of the path of another ball subsequently putted rearwardly to the device on a path parallel to the longitudinal center thereof. It is noted that not all balls which roll onto the sloping area 16 will roll by gravity to a position outside of the path of a subsequently putted ball. A slowly rolling ball may not reach a sufficiently high position on the sloping area to roll by gravity with sufficient speed to roll across the front rim 26. Also, it is possible that a ball may deflect forwardly from the barrier 19 at such a high speed that the ball may not be directed by gravity to a position outside of the path of a subsequently putted ball. Therefore, the term "suitable speed and location", as used in this description and in the appended claims, describes a speed and location at which a ball may roll onto the sloping area 16 and be directed by gravity to a position on the playing surface outside of the path of a subsequently putted ball. Some examples of such suitable speeds and locations are illustrated by the ball paths on FIG. 1, and are described as follows:

A ball rolling slowly rearwardly on a path as illustrated by the ball path 41 may be directed outwardly by gravity and may roll off the device at an angle of approximately 90 degrees from the longitudinal center of the device.

A ball which deflects from the barrier 19 onto the sloping area 16 may begin rolling by gravity from an approximately stationary position thereon, as illustrated by the ball path 42, and roll forwardly and outwardly off the device at an angle of approximately 45 degrees from the longitudinal center of the device.

A ball may deflect from the barrier 19 onto the sloping area 16 at such a speed and direction that the ball will not begin rolling by gravity from a stationary position on the sloping area, but, as illustrated by the ball path 43, may be directed by gravity to a path leading sufficiently outwardly to permit the ball to roll onto the playing surface to a position outside of the path of a subsequently putted ball.

The barrier 19, as previously described, provides an indication to the player as to whether or not the speed of a golf ball putted rearwardly toward the device is greater than the approximate maximum speed at which a golf ball may be putted toward a regular golf hole at a corresponding location and fall into the hole, the ball passing over the barrier when the speed is too great. The barrier also provides an indication as to the direction of a putted ball. A ball which strikes an outer portion of the barrier while the ball is rolling rearwardly on a path parallel to the longitudinal center of the device will deflect inwardly if the center of the ball is inside either of the respective outer ends 21 of the front face of the barrier; while a ball will deflect outwardly if the center of the ball is outside of the respective outer ends 21. Because of the disposition of the outer portions of the front face 20 of the barrier, a ball which is rolling on a path where the ball is in continuous contact with the barrier, while also rolling upon a surface in front of the barrier, will be permitted to be traveling on a path leading outwardly as the ball rolls past either of the respective outer ends of the barrier, so that the ball may be permitted to roll off the device to a position on the playing surface outside of the path of a subsequently putted ball. The disposition of the outer portions of the front face 20 of the barrier 19, relative to the direction of the slope of the sloping area 16, permits a ball to roll downwardly on the sloping area by gravity while the ball is in contact with the front face of the barrier.

The device is stabilized against tipping rearwardly by the playing surface 36 resisting the downward movement of the anti-tipping stabilizer 23, caused by the impact of a rearwardly rolling ball against the barrier 19. The device is stabilized against rearward sliding by the fibers of a carpet, or the grass of a golf green, resisting the rearward movement of the anti-sliding stabilizers 24, caused by the impact of a rearwardly rolling ball against the device.

Another embodiment of the invention is illustrated in FIG. 4. This embodiment is similar to the embodiment of FIG. 1, except for the differences and variations described as follows:

The embodiment of FIG. 4 is molded with a more resilient or flexible material to permit the barrier 19 to absorb the energy of a putted ball more gradually. The embodiment of FIG. 4 does not have a front rim 26, therefore the upper surface of the ball support 12 is of a constant height throughout its area. The front edge 13 of the ball support 12 is made up of a straight portion **13*a*, extending throughout the approximate width of a golf hole, and two arcuate side portions 13*b*, which are tangent to the straight portion and have the centers of their respective arc radii located at the respective outer ends 21 of the front face of the barrier 19. Thus, a putted ball rolling inwardly toward an outer end of the barrier may roll across the arcuate portions of the front edge 13 with a minimum of lateral deflection. The front face 14 of the ball support is vertical rather than being beveled. A ball will encounter somewhat more impedance to its travel when rolling across a vertical front face, rather than a beveled front face; however, a vertical front face will have more durability. The respective outer sides of the ball support 12 are disposed along lines extending from the respective outer ends of the front edge of the ball support to the respective outer ends of the front face of the barrier 19**.

The sloping area 16 is similar to the sloping area of the embodiment of FIG. 1, excepting that the intersections of the plane surfaces **16*a* and 16*b* with the ball support 12 are filleted. The lines 17*a* and 17*b* represent the lines along which the respective plane surfaces, if extended, would join the upper surface of the ball support. A filleted area extends between the lines 16*c* and 17*c*, on the left, and between the lines 16*d* and 17*d*, on the right, these lines representing the lines along which the filleted area becomes tangent with the respective sloping plane surfaces and with the ball support 12. The filleted area has fillet radii greater than the radius of a golf ball, with the fillet radii being greatest at approximately the centers of the respective lines 17*a* and 17*b* and becoming gradually smaller toward each of the ends of the respective lines 17*a* and 17*b*. Thus, the tangency lines 17*c* and 17*d*** are curved outwardly between their respective ends, which gives the edges of the sloping area a somewhat circular appearance to simulate the front perimiter of a golf hole.

The barrier 19 in the embodiment of FIG. 4 is made up of a plurality of individual members **19*c* which combine to form a rear wall 19*b*, which is similar to the rear wall 19*a* of the embodiment of FIG. 1, excepting that the front face 20 of the rear wall 19*b*** has an overall concave shape rather than being made up of an arcuate central portion and two straight side portions.

The amount of resistance to the rearward travel of a golf ball, provided by the rear wall **19*b* in the embodiment of FIG. 4, is somewhat less in the central portion of the wall, and somewhat greater in the respective outer portions of the wall, than in the rear wall 19*a* in the embodiment of FIG. 1. The purpose of this is to provide a device which may be used to practice speed control in putting, the player attempting to putt a ball to the device at a speed somewhat greater than the maximum speed at which the ball could be traveling and fall into a golf hole if putted to an outer edge of the hole, while putting the ball at a speed which is somewhat less than the maximum speed at which the ball could be traveling and fall into the hole if putted to the center of the hole. To establish the height of the rear wall 19*b*, a method similar to the method previously described may be used, excepting that the maximum speeds at which balls may be rolled to the device without the balls passing over the rear wall 19*b*** will be suitable maximum speeds selected for various locations, rather than the maximum speeds at which balls could be rolled toward a regular golf hole at corresponding locations and fall into the hole.

The device of FIG. 4 does not have anti-sliding stabilizers 24, as used in the device of FIG. 1, but rather the rear edge **23*b* of the anti-tipping stabilizer 23 is substantially straight, and normal to the longitudinal center of the device, so that the device may be stabilized against sliding by a separate object 31 which is placed against the rear edge 23*b***. The separate object may be an object such as a floor mat or a sheet of rubber.

The embodiment of the invention illustrated in FIG. 4 is used and operates in a manner similar to the embodiment of FIG. 1, with the following variations:

The embodiment of FIG. 4 may be used on a playing surface which would not allow members which protrude from the bottom surface of a device to penetrate below the upper surface of the playing surface. The device may be stabilized against sliding by placing a suitable separate object 31 against the rear edge **23*b* of the anti-tipping stabilizer 23. It is desirable that the separate object be sufficiently thin so that putted balls which pass rearward of the barrier may roll across the separate object. Putts may be directed to the barrier 19, with the player attempting to putt a golf ball at a speed suitable for the ball to reach the barrier, without passing thereover. A putted golf ball will pass over the barrier 19 if the speed of the ball as it reached the front edge 13** of the device at any particular location was greater than a predetermined approximate maximum speed pertaining to the particular location at which the ball reached the front edge of the device; while the ball will not pass over the barrier if the speed of the ball as it reached the front edge of the device was not greater than the predetermined approximate maximum speed pertaining to the particular location. The device will thus be useful for practicing speed control in putting.

While two embodiments of the invention have been described in detail, these configurations are provided only as examples of possible embodiments of the invention. Many other configurations are possible within the scope of the invention. Some examples of such configurations are described as follows:

At least portions of the device may be made by methods other than molding, such as forming or stamping sheet metal or the like. The device, or individual members thereof, may be made by assembling two or more individual parts. The bottom surface 15 of the device need not be continuously flat, but may be made up of suitable bottom portions of the device which may rest on a flat playing surface. The thickness of the ball support 12 may be greater than the minimum required for strength. A ball will encounter more impedance when rolling from the playing surface onto a thicker ball support; thus a thicker ball support may be useful in a device to provide practice in putting a ball firmly. The front edge 13 of the ball support may be curved somewhat within a width representing the width of a golf hole, and the front face 14 may be somewhat rounded rather than being beveled or vertical.

The direction of the steepest slope of the sloping area 16 may be at any suitable angle, rather than at 45 degrees from the longitudinal center of the device. Rather than the sloping area being made up of plane surfaces, it may be contoured so that the steepness and direction of the slope may differ in different portions of the sloping area.

Also, the sloping area 16 in the embodiment illustrated in FIG. 1 may be contoured so that the sloping area extends forwardly and outwardly to join the bottom of the front wall 27, thus eliminating the inner portion **12*b* of the ball support 12. The maximum width of the sloping area 16 may be somewhat wider or narrower than the width of the front face 20 of the barrier 19. Also, the front wall 27 may slope downwardly and inwardly from the front rim 26, rather than being vertical, so that a golf ball may roll outwardly across the front rim 26 with somewhat less impedence than when rolling across a vertical wall. The simulated golf hole area 28 in the embodiment of FIG. 1** may be of any size and shape suitable for simulating the area of a regular golf hole.

The respective outer portions of the front face 20 of the barrier 19 may be disposed at any angle suitable for useful functioning of the device, rather than being disposed at an angle of 45 degrees from the longitudinal center of the device. Also, the exterior side faces 22 of the barrier may be suitably disposed at angles other than 90 degrees from the front face 20 of the barrier. The total width of the front face 20 may be any suitable width for simulating the width of a golf hole. The barrier 19 may be made up of other types of members such as hinged, weighted, or spring loaded members which will provide resistance to the travel of a golf ball and which will provide an indication as to the speed of a golf ball. Instead of the barrier members being attached at their bases, the barrier may be made up of a plurality of members which are pivotally attached at their upper ends to a structure, so that when the speed of a rearwardly rolling ball is greater than a predetermined approximate maximum speed the lower ends of the members will be pushed rearwardly, permitting a ball to pass underneath the barrier structure, rather than over the barrier. Thus the word "barrier" describes any structure which will provide a predetermined amount of resistance to the travel of a rearwardly rolling golf ball, and which will provide an indication as to when a ball is traveling at a speed greater than a predetermined approximate maximum speed. The "front face" of the barrier is the portion of the barrier which a rearwardly rolling golf ball first contacts when striking the barrier within a width thereon simulating the width of a regular golf hole.

Instead of the barrier 19 being a wall which has only sufficient thickness for strengh, the barrier structure may extend rearwardly to the rear edge of the device, and be constructed so that the center of a ball rolling at a speed greater than a predetermined speed will pass rearward of the front face of the barrier, but will not pass rearward of the entire barrier structure. The amount of resistance to the rearward travel of a ball, provided by the barrier, may be established so that the approximate maximum speed at which a golf ball may be putted rearwardly to the device at any particular location, without passing rearward of the front face of the barrier, may be any maximum speed suitable for the particular use of the device.

It is noted that a target area similar to the target area 25 of the embodiment illustrated in FIG. 1 may be added to the embodiment illustrated in FIG. 4, the target area being of any suitable size and shape to simulate at least a portion of a golf hole.

It is also noted that an embodiment of the type illustrated in FIG. 4 may be made into an embodiment of the type illustrated in FIG. 1 by adding a front rim 26 outside of the sloping area 16, the front rim being formed by adding a thin sheet of material on top of the ball support 12 in the area outside of the perimiter of the front rim. Thus a simulated golf hole area 28 will be designated on the device between the barrier 19 and the added front rim 26.

The best mode contemplated for carrying out the invention is preferably an embodiment of the type illustrated in FIG. 1. However, embodiments of the type illustrated in FIG. 4 will be useful for specialized putting practice.

While various embodiments of the invention have been described in detail, it is to be understood that these are intended by way of illustration and example only and are not to be taken by way of limitation. Accordingly, the scope of this invention should be determined only by the following claims.

I claim:

1. A golf putting practice device comprising:

a bottom surface 15 which is substantially flat and which comprises at least a portion of the bottom area of the device so that said bottom surface 15 may support the device as it rests on a playing surface 36;

a ball support 12 located in the front portion of the device and extending sufficiently rearwardly to support a golf ball as it rolls rearwardly thereon to any adjacent member of the device, the width of said ball support 12 being at least the approximate width of a regular golf hole and the thickness being at least sufficient to support a golf ball, the upper surface to said ball support 12 being substantially parallel to said bottom surface 15 of the device, the front edge of said ball support 12 being disposed substantially normal to the longitudinal center of the device;

a sloping area 16 located rearward of the front face of said ball support 12 and comprising two side portions, each of which slopes upwardly in a rearward and inward direction so that the two side portions join at the longitudinal center of the device, the respective outer edges of the front portion of said sloping area 16 extending outwardly from front to rear and being positioned so that the height of said outer edges is substantially no greater than the height of the upper surface of said ball support 12, so that a golf ball may roll rearwardly therefrom onto said sloping area 16 with substantially a minimum of impedance to the travel of the ball;

a barrier 19 located rearward of said sloping area 16 and said ball support 12, the front face of said barrier 19 extending outwardly approximately equidistantly from the longitudinal center of the device and having a total width substantially the width of a regular golf hole, the front face of said barrier 19, as seen in the plan view, having an overall concave shape, with the respective outer portions thereof being disposed at an angle leading forwardly and outwardly from the central portion thereof, said barrier 19 having means for providing a predetermined amount of resistance to the travel of a golf ball rolling rearwardly on said sloping area 16 or said ball support 12, the amount of said resistance being such that the center of a rearwardly rolling golf ball will pass rearward of the front face of said barrier 19 if the speed of the ball as it strikes said front face is greater than a predetermined approximate maximum speed pertaining to the particular location struck, while the center of the ball will not pass rearward of said front face if the ball strikes said front face at a speed which is not greater than said approximate maximum speed pertaining to said particular location struck, the amount of said resistance to the rearward travel of a ball being greater in the central portion of said barrier 19 than in the respective outer portions thereof;

means for enabling the device to be sufficiently stabilized against rearward tipping and sliding so that the device may be useful for practicing putting.

2. The device of claim 1, further comprising:

a front rim 26 having a concave shape simulating the front rim of a regular golf hole and being located in front of and outside of the front perimeter of said sloping area 16, said front rim 26 being located at the upper edge of a shallow front wall 27 which extends downwardly from the upper surface of said ball support 12 to a lower surface inside said front rim 26, the height of said front wall 27 being sufficiently large so that a golf ball which has rolled rearwardly from said ball support 12 across said front rim 26 to a slow speed may be retained within the perimeter of said front rim 26, while the height of said front wall 27 is sufficiently small so that a ball which has rolled with sufficient speed down said sloping area 16 may roll outwardly across said front rim 26 and onto the upper surface of said ball support 12.

3. The device of claim 2 wherein said means of said barrier 19 for providing resistance to the travel of a rearwardly rolling ball comprises an upstanding wall **19*a* attached to adjacent portions of the device, the height of said wall 19*a* being such that the center of a rearwardly rolling golf ball will pass over the front face of said wall 19*a* if the ball strikes the wall at a speed greater than a predetermined approximate maximum speed pertaining to the particular location struck, while the center of the ball will not pass over the front face of said wall 19*a* if the ball strikes the wall at a speed which is not greater than said predetermined approximate maximum speed pertaining to said particular location struck, the height of said wall 19*a*** being greater in the central portion thereof than in the respective outer portions thereof.

* * * * *